US005205477A

United States Patent [19]

Zimmermann

[11] Patent Number: 5,205,477

[45] Date of Patent: Apr. 27, 1993

[54] INTERLOCKING CARTON AND LID

[75] Inventor: John Zimmermann, Scarborough, Canada

[73] Assignee: Paperboard Industries Corporation, Mississauga, Canada

[21] Appl. No.: 894,927

[22] Filed: Jun. 8, 1992

Related U.S. Application Data

[63] Continuation-in-part of Ser. No. 818,383, Jan. 9, 1992, Pat. No. 5,148,973.

[51] Int. Cl.[5] ..... B65D 43/08

[52] U.S. Cl. ..... 229/125.28; 229/125.26

[58] Field of Search ..... 229/125.19, 125.26, 229/125.28, 125.01; 220/306, 4.21

[56] References Cited

U.S. PATENT DOCUMENTS

| | | | |
|---|---|---|---|
| 2,456,841 | 12/1948 | Rushing | 229/125.28 |
| 2,551,814 | 5/1951 | Rushing et al. | 229/125.28 |
| 2,777,630 | 1/1957 | Moberger | 229/725.28 |
| 3,337,116 | 8/1967 | Nowak | 229/125.28 |
| 3,352,475 | 11/1967 | Centanni | 229/125.28 |
| 4,915,291 | 4/1990 | Galber | 229/125.26 |
| 5,040,722 | 8/1991 | Fromion et al. | 229/125.26 |

FOREIGN PATENT DOCUMENTS

| | | | |
|---|---|---|---|
| 2644139 | 9/1990 | France | 229/175.28 |

*Primary Examiner*—Allan N. Shoap

*Assistant Examiner*—Christopher McDonald

*Attorney, Agent, or Firm*—Shlesinger, Arkwright & Garvey

[57] ABSTRACT

An interlocking carton and lid combination is disclosed for storage of ice cream, frozen yogurt and the like. The interlocking combination includes a rectangular container provided with flaps integrally formed therewith and attached along a crease inwardly into the container and glued along a strip portion to the side walls. A slot is provided in each of two opposed sides on the exterior thereof, the slots formed in the side wall between the crease and the glue strip adhesively coupling the flap to the side wall. This positioning of the slot with respect to the crease and glue strip causes the unglued portion of the flap to bow outwardly. A lid having a central portion has transversely extending flanges integrally formed and attached to the peripheral edges of the central portion. The flanges include an outer side and an inner flap portion connected along a crease. Two opposed flanges have slots located in the respective flap portions and the flaps are glued to the respective outer sides along a strip portion located between the slot and the edge of the flange spaced from the crease. This configuration causes the unglued portion of the flap between the crease and the slot to bow outwardly. The lid is receivable on the container wherein the lid slots interfere with the container side slits.

8 Claims, 7 Drawing Sheets

INTERLOCKING CARTON AND LID

This is a continuation-in-part of U.S. patent application Ser. No. 07/818,383 filed Jan. 9, 1992, now U.S. Pat. No. 5,148,973.

FIELD OF THE INVENTION

The subject invention relates to self locking carton and lid combinations.

BACKGROUND OF THE INVENTION

The need for interlocking cartons and lids for foodstuffs such as ice cream and yogurt to mention just a few is well known. Current interlocking carton and lid designs are of several types. In one such design of an ice cream container each side of the carton is provided at the upper end with an integrally formed peripheral flap which is folded down and glued on the outside of the carton. The bottom edge of this flap forms a catching edge. A drawback to this type of arrangement is the added fabrication expense associated with an extra pass in the carton gluing procedure.

In another locking arrangement, a cardboard container and a plastic lid is provided in which the plastic lid includes a deep peripheral grove portion which receives the upper peripheral edge of the container. Notches extending into the grove from the plastic lid must friction fit into die-cut apertures in several places on flanges located on the interior of the cardboard container. Several drawbacks to this type of arrangement are the need for critical manufacturing tolerances which increase fabrication costs. Also, during production, the lid must be carefully aligned with the container when fitting the former to the latter. Finally, the apertures located on the interior of the container become clogged with the material being stored therein which interferes with the locking function.

Accordingly, it would be desirable to provide an ice cream carton and lid assembly utilizing a locking mechanism which minimizes fabrication and assembly costs and which mechanism is not interfered with by the material being stored in the container.

SUMMARY OF THE INVENTION

The subject invention provides an interlocking carton and lid assembly for storing of ice cream and the like. In one aspect of the invention a generally rectangular storage carton is provided having side members and a bottom member, the carton including a top opening for providing access into the interior of the carton. At least two opposed side members are provided each with a peripheral flap integrally formed therewith at the upper edges thereof adjacent the top opening with the flaps adhesively coupled to the interior surface of the corresponding side members. The connection between the flaps and the side members forms a crease, with the at least two opposed side members each provided with at least one slit located therein at a predetermined position between the crease and the outer edge of the flap. The adhesive coupling between the flap and the interior surface of the side member is positioned between the slit and the outer edge of the flap. This configuration causes the unglued portion of the side member located between the crease and the slit to bow outwardly due to spring tension created in the unglued portion by the close proximity of the slit to the crease.

There is also provided a lid having a generally rectangular central portion wherein each peripheral edge portion of the lid is provided with a flange member integrally formed therewith and extending substantially perpendicularly therefrom. At least two opposed flange members are provided each with a flap member attached to the outer peripheral edge thereof and which is integrally formed therewith. The connection between the flaps and the flange member forms a crease. The flaps are adhesively coupled to the interior surface of the corresponding flange members with the at least two opposed flange members each provided with at least one slit located therein at a predetermined position between the crease and the outer peripheral edge of the flap. The adhesive coupling between the flap and the interior surface of the flange member is positioned between the slit and the outer edge of the flap, wherein that unglued portion of the flap member located between the crease and the slit is bowed outwardly due to spring tension created in the unglued portion by the close proximity of the slit to the crease.

The lid member is receivable onto the carton in such a way that the slits in the flaps of the lid member pass over and are in registration with the slits located in the side members. The bowed out portion of the flap in the container lid passes over the bowed out portion of the container side so that the respective slits interfere with one another thereby locking the lid and carton together.

BRIEF DESCRIPTION OF THE DRAWINGS

The invention will now be described by way of example only, reference being had to the accompanying drawings, in which.

DETAILED DESCRIPTION OF THE INVENTION

Figure 1:
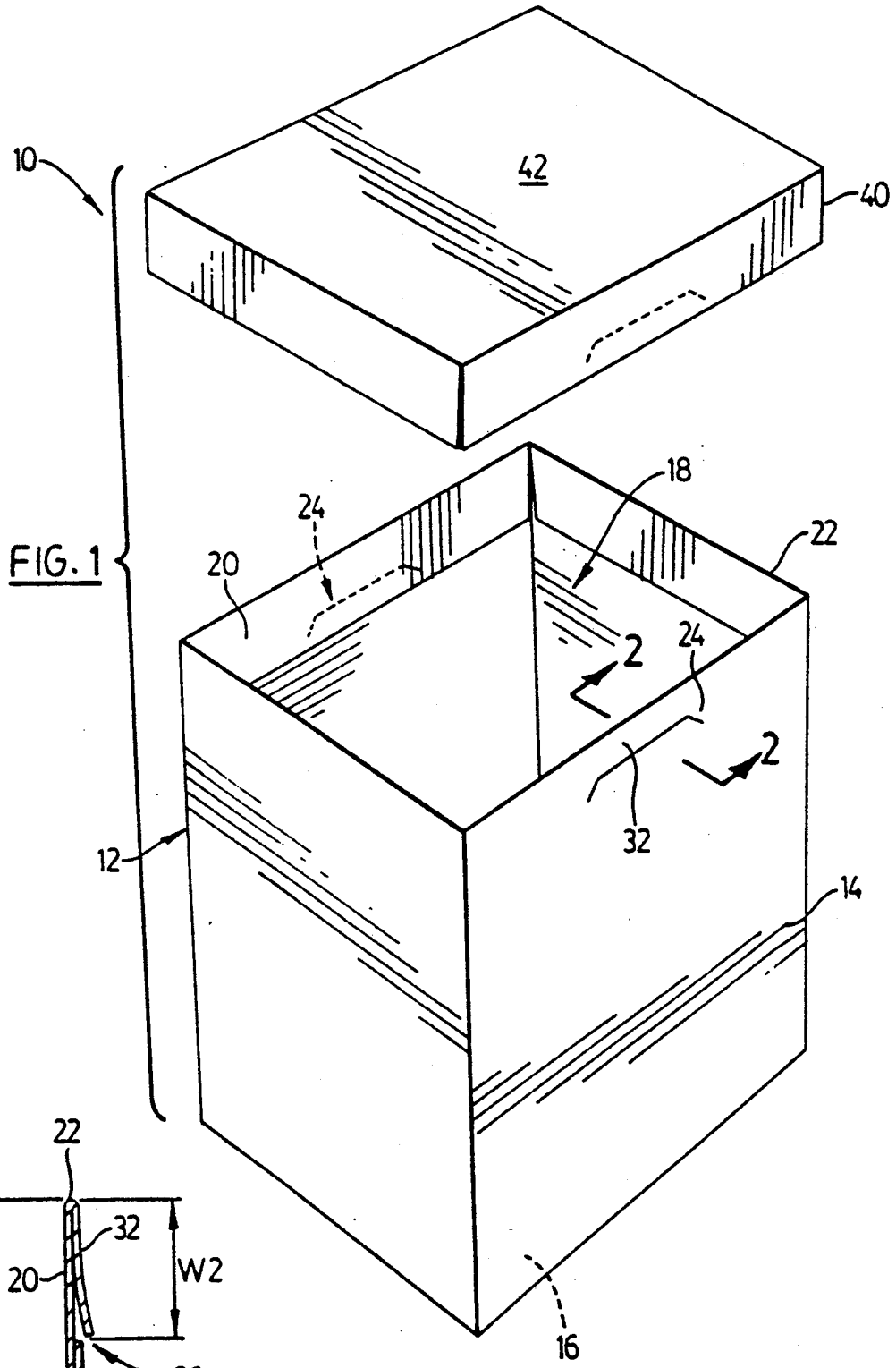
FIG. 1 is a perspective view of a carton and lid provided with a locking mechanism in accordance with the subject invention.
Figure 2:
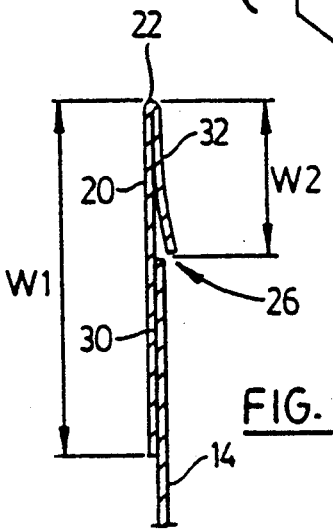
FIG. 2 is a sectional side view of the upper portion of the carton taken along the lines 2—2 of FIG. 1.
Figure 3:
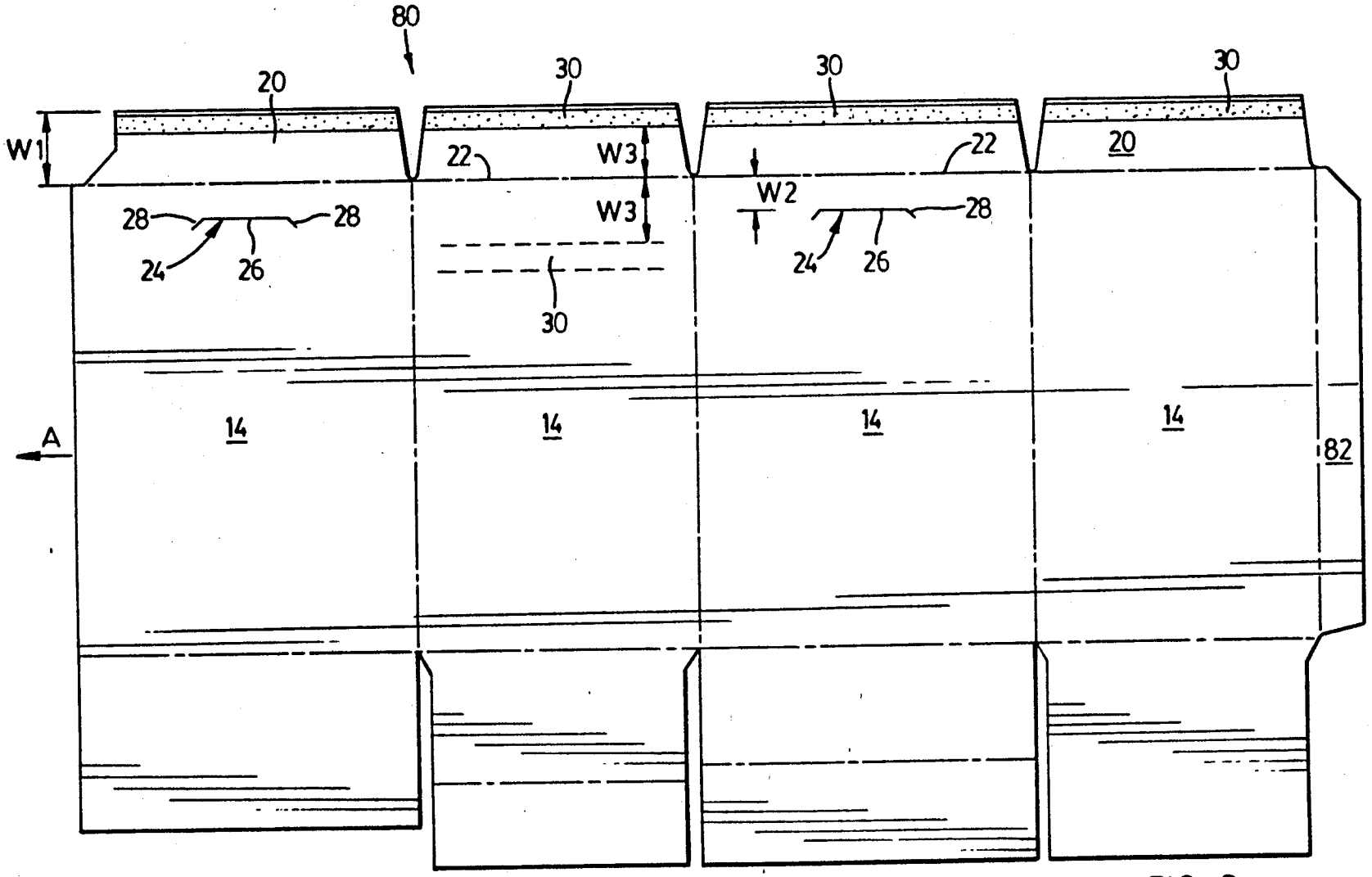
FIG. 3 is a top view of a carton blank provided with the locking mechanism of the subject invention.

In the ensuing description of the structure and operation of the locking mechanism of the subject invention, reference will be made to the Figures wherein like numerals refer to like parts. Referring first to FIGS. 1 to 3, a rectangular shaped carton and lid assembly 10 are shown and include a carton 12 having sides 14 and a bottom 16. Carton 12 has a top opening 18 for adding to and removing material from container 12. Sides 14 are each provided with a flap 20 of width W1 integrally formed therewith and connected along the upper edge thereof. Flaps 20 are folded inwardly into the interior of carton 12 thereby forming creases 22 along the upper edges of sides 14. The carton blank 80 shown in FIG. 3 is provided with a sealing flap 82 for sealing the outer panels 14 together when blank 80 is assembled into a carton. The carton may be formed using an outside seal whereby flap 82 is glued to the outside surface of opposed panel 14 so that the glue seam is on the outside of the carton. Alternatively, flap 82 may be glued to the inside surface of opposed panel 14 so that the glue seam is located on the interior surface of the assembled carton. This latter arrangement provides for a more aesthetically pleasing appearance since there is no interruption of the carton graphics.

Carton 12 is provided with a pair of slits 24 with each slit located on an opposed side 14. Slits 24 are provided with a horizontal portion 26 and end portions 28 extending at an angle downwards. Slit portion 26 is spaced a distance W2 from crease 22 wherein W2<W1. Flaps 20 are adhesively bonded to the inner surface of sides 14 along an adhesive strip or glue seam 30 wherein the glue seam is positioned so that when flap 20 is bonded to wall 14, slit 24 is located between the glue seam and crease 22. The unfolded carton shown in FIG. 3 more clearly illustrates the relative positioning of glue seam 30 on flaps 20, the latter being spaced W3 (>W2) from crease 22 and the positioning of slits 24 in sides 14. Referring to FIG. 2, the portion 32 of side 14 located between horizontal slit portion 26 and crease 22, is bowed outwardly, this outward bowing being due to tension generated in portion 32 in a direction normal to the plane of side 14 due in part to the close proximity of crease 22 and the fibrous nature of the cardboard material from which carton 12 is fabricated.

Figure 4:
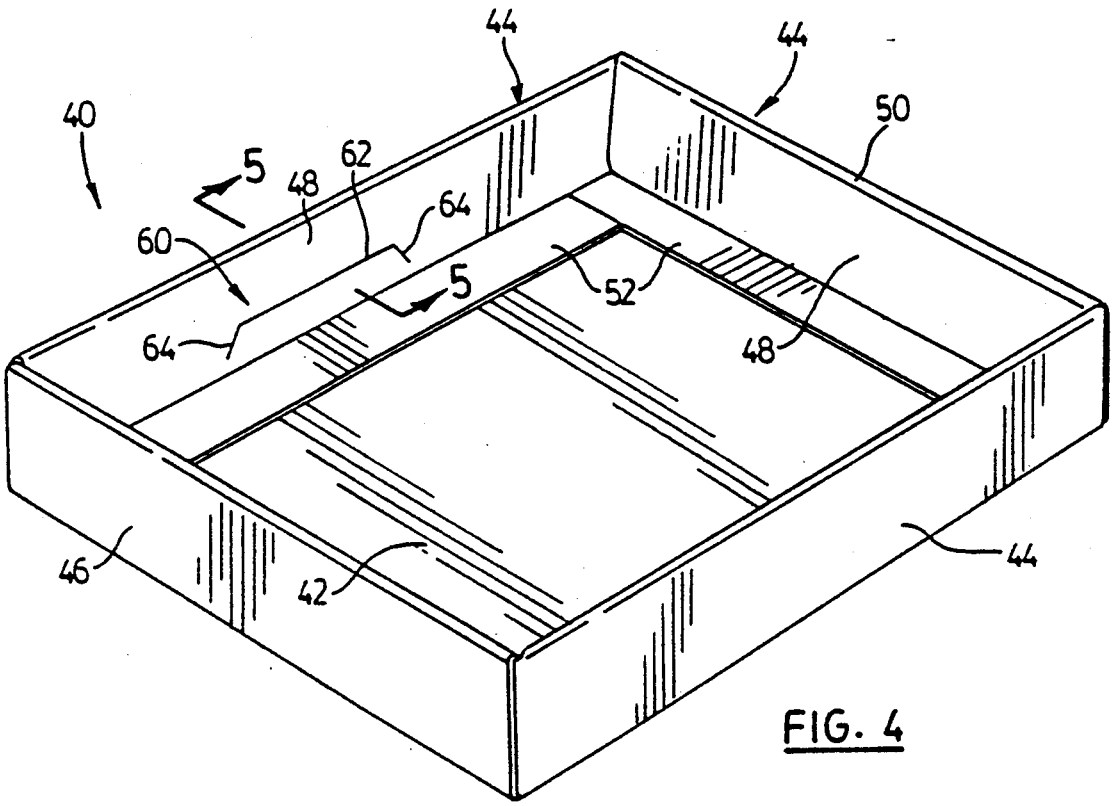
FIG. 4 is a perspective view of the interior of the lid of FIG. 1.
Figure 5:
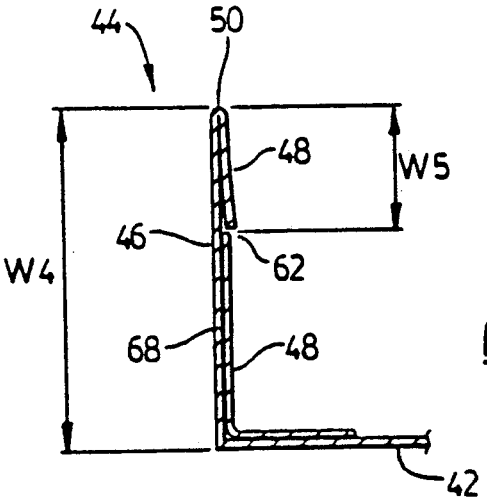
FIG. 5 is a sectional side view of the lid taken along the lines 5—5 of FIG. 4.
Figure 6:
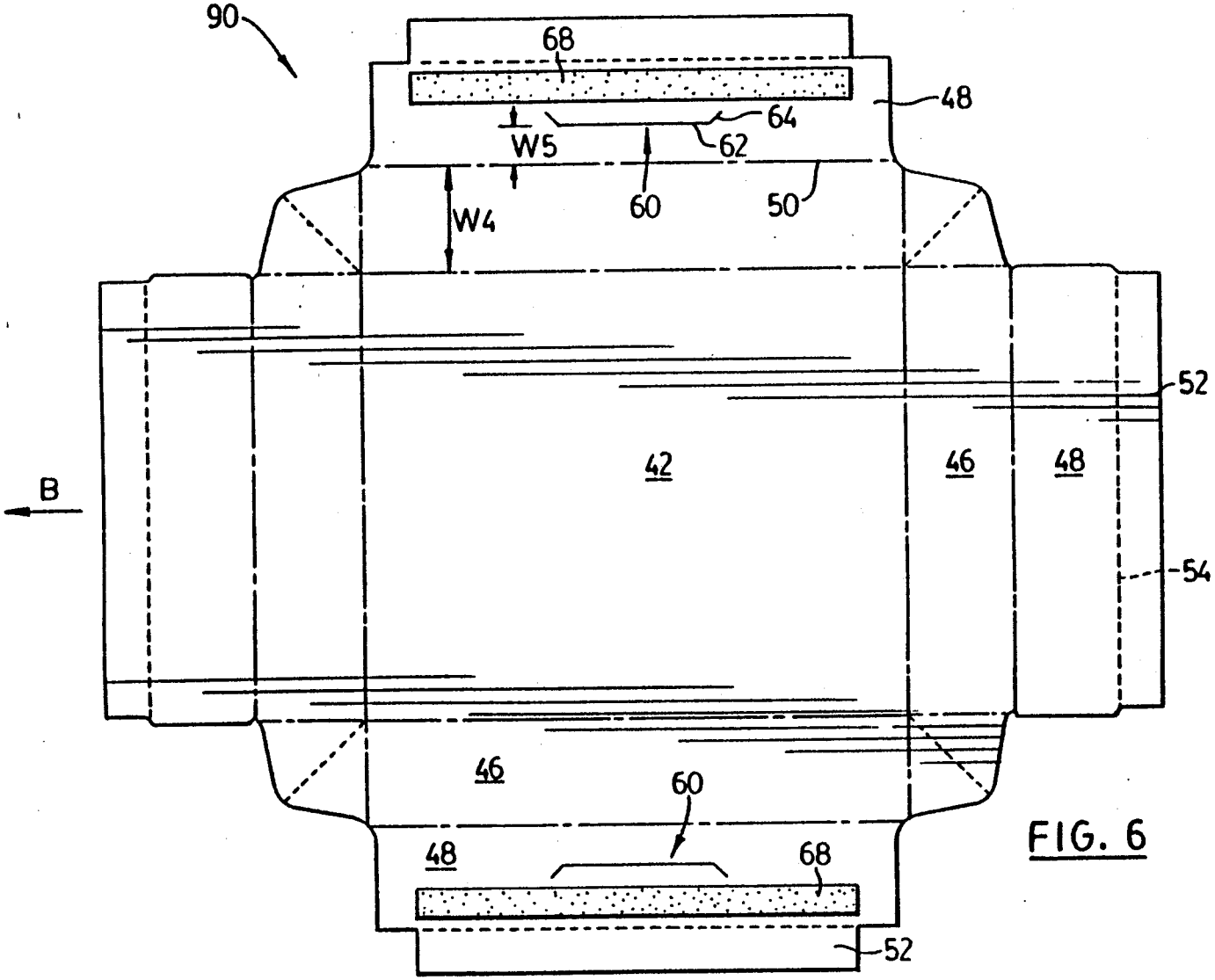
FIG. 6 is top view of an carton lid blank embodying the locking mechanism of the subject invention.

Referring now to FIGS. 4, 5 and 6, a lid shown generally at 40 is provided for carton 12. Lid 40 includes a top portion 42 and side flanges 44 connected to the outer peripheral side edges of top portion 42. Side flanges 44 are of width W4 and are preferably integrally formed with to portion 42 and extend transversely therefrom. Flanges 44 include an outer portion 46 and an inner flap member 48 attached to portion 46 along the peripheral edge of portion 46 and integrally formed therewith. Flaps 48 are folded inwardly into the interior of lid 40 thereby forming creases 50 along the bottom edges of flanges 44. Attached along the peripheral edge of flap portions 48 are reinforcing elongate tabs 52 integrally formed therewith which are folded along crease 54 and lie against top portion 42.

Lid 40 is provided with a pair of slits 60 one located on each of a pair of opposed flap 48. Slits 60 are provided with a horizontal portion 62 and end portions 64 extending at an angle outwardly and downwardly. Slit portion 62 is spaced a distance W5 from crease 50 wherein W4>W5. Flaps 48 are adhesively bonded to the inner surface of flange outer portion 46 along an adhesive strip or glue seam shown generally at 68 wherein strip portion 68 is positioned so that when flap 48 is bonded to flange portion 68, slit 62 is located between adhesive strip 68 and crease 50. The blank lid 90 shown in FIG. 6 more clearly illustrates the relative positioning of adhesive strips 68 and slits 60 on flaps 48. The portion of flap 48 located between slit 60 and crease 50, shown at 70, is bowed outwardly as shown in FIG. 5, this outward bowing being due to tension generated in portion 70 in a direction out of the plane of side flap 48 due in part to the close proximity of crease 50 and the fibrous nature of the cardboard material from which lid 40 is fabricated.

Referring to the top views of FIGS. 3 and 6, end slit portions 28 and 64 extend outwardly from the respective central slit portions at an angle less than 90 degrees in order to avoid problems during fabrication of the carton and lid portions. Specifically, the lid and carton blanks 90 and 80 respectively move in the direction indicated by arrows A and B in FIGS. 3 and 6. It has been found that if the slit end portions are angled at 90 degrees relative to the central slit portions and hence the direction of travel, these end slit portions are inadvertently grabbed by various pieces of equipment thereby necessitating the shutdown and realignment. By angling the slit end portions as disclosed herein, this problem is reduced while still facilitating the bowing outwards of the unglued flap and side portions.

To provide for the interlocking combination of lid 40 and carton 12, the dimensions W2, W4 and W5 are chosen to satisfy the inequality W4−W5>W2, while simultaneously satisfying the criteria that W2 and W5 be sufficiently small so that the respective unglued portions 32 and 48 adjacent slits 24 and 60 respectively ar bowed outwardly.

Figure 7:
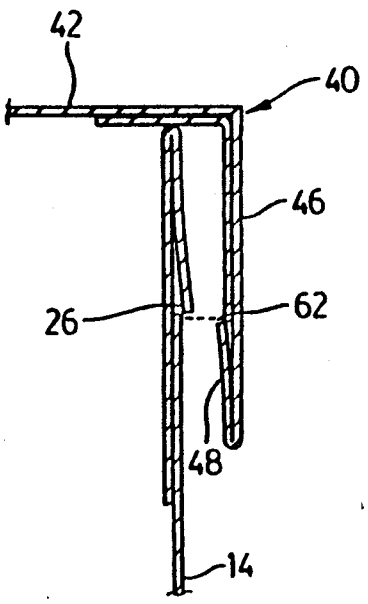
FIG. 7 is a sectional view showing the relationship of a portion of the lid and carton in the closed position with the carton side wall and lid shown spaced apart.

In operation, lid 40 is oriented to be received by carton 12 so that the flanges of lid 40 containing the slits 60 are in registration the sides 14 of carton 12 containing the slits 24. Since W4−W5 is slightly greater than W2, the lid bowed out portions 48 pass over the carton side wall bowed out portions 32 as lid 40 is pressed all the way onto carton 12 so that slit portions 62 and 26 come into registration as shown in FIG. 7 except that the slits are spaced apart along the dotted line for clarity. In the closed position, the edge of portion 70 adjacent slit 62 of the lid abuts the edge of portion 32 of adjacent slit 24 thereby locking the lid and carton together. Peripheral tabs 52 abutting creases 22 aid in forming an air tight seal between the lid and carton thereby forming a positive lock.

In order to remove lid 40 from carton 12, the sides 14 containing slits 24 ar squeezed inwardly a sufficient distance to compress portions 32 inwardly with respect to inwardly protruding portions 70 of lid 40, whereupon lid 40 can be readily removed from carton 12.

The locking mechanism disclosed herein has been discussed using one slit located on opposed container sides and opposed flanges of the lid. It will be appreciated that more than one slit may be utilized on the opposed container sides and lid flanges so long as each slit in the former is in registration with a slit in the latter. In addition, while the slit portions shown adjacent the bowed out portions are parallel the respective creases, it will be understood that these slit portions could be inclined at an angle with respect to the creases without departing from the width parameters.

Figure 8:
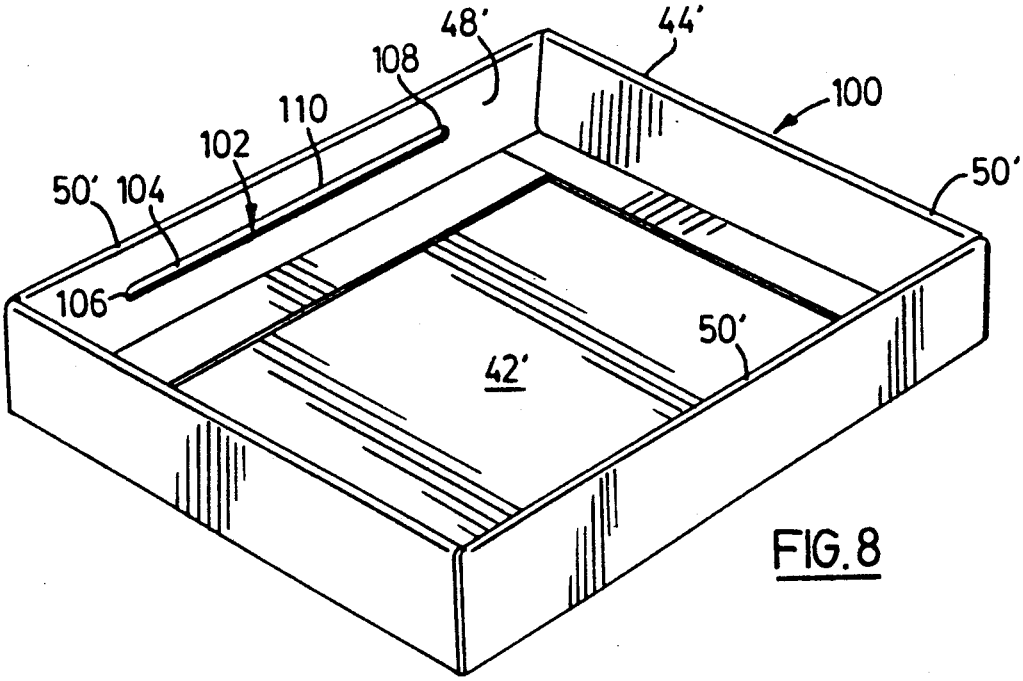
FIG. 8 is a perspective view of the interior of another embodiment of a lid forming part of the present invention.
Figure 9:
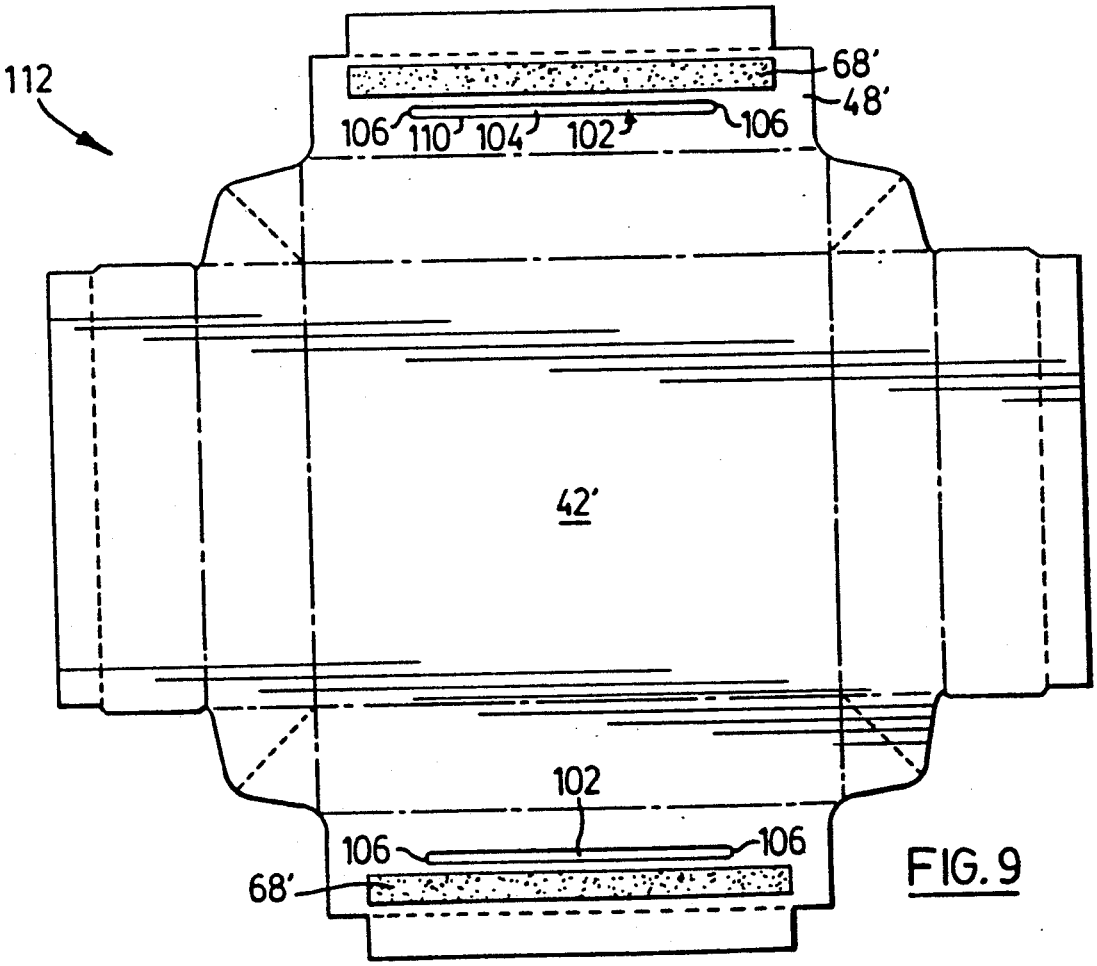
FIG. 9 is top view of an carton lid blank used in making the carton lid shown in FIG. 8.

Because the interlocking connection between the lid and the carton is provided by interference between the outwardly bowed portions of the flaps between the crease and the slit on the lid and carton when the former is placed on the latter, it will be readily apparent to those skilled in the art that the slits in either the carton, the lid, or both the carton and lid could be widened to provide slots. Removing material between the slit and the peripheral edge of the flap thereby producing a slot does not impact on the function of the interlocking connection. A slot advantageously provides a view port for observing for example the uniformity of the glue seam. Further, a slot avoids potential problems which may arise in fabricating the embodiments of the carton and lid having only slits. Specifically, during fabrication of the die-cut slits the die knife may fail to cut all the way through the carton material, known to those skilled in the art as "off-cutting", a situation avoided by forming slots. A disadvantage of using slots is obvious interruption of the carton graphics, which will tend to distract from the aesthetic appeal of the carton. The various combinations of lids having slots or slits may be used in conjunction with cartons having either slits or slots. Referring now to FIGS. 8 and 9, an alternative embodiment of a lid is shown at 100 and includes a pair of slots 102 one located on each of a pair of opposed inner flaps 48' located on the interior of flanges 44'. Slots 102 are each provided with a horizontal portion 104 and rounded end portions 106. The blank shown generally at 112 in FIG. 9 shows the relative positioning of slot 102 to adhesive strip 68' and crease 50' in flap 48' which is such as to cause that portion of inner flap 48' between (and including) slot edge 110 and crease 50' in the assembled carton lid to bow outwardly for the same reasons as discussed with respect to lid 40 in FIG. 4.

Figure 10:
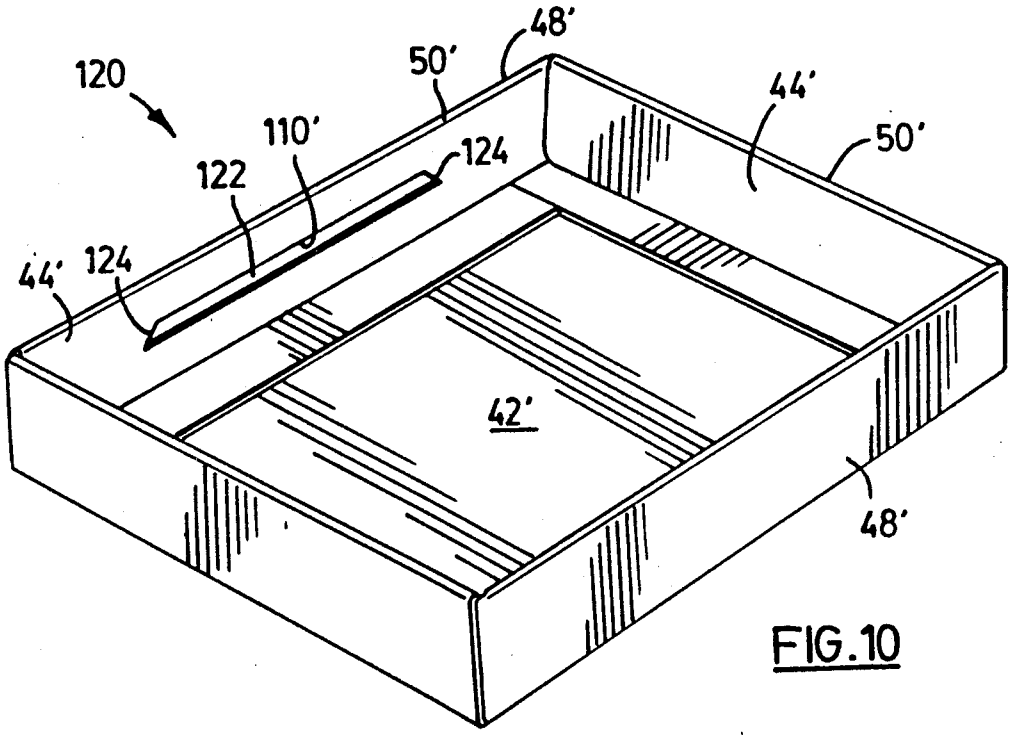
FIG. 10 is a perspective view of the interior of yet another embodiment of a lid forming part of the present invention.

FIG. 10 illustrates another embodiment of a lid at 120 similar to the one shown in FIG. 8 having a slot 122 provided with a horizontal portion 124 and angled end portions 126.

Figure 11:
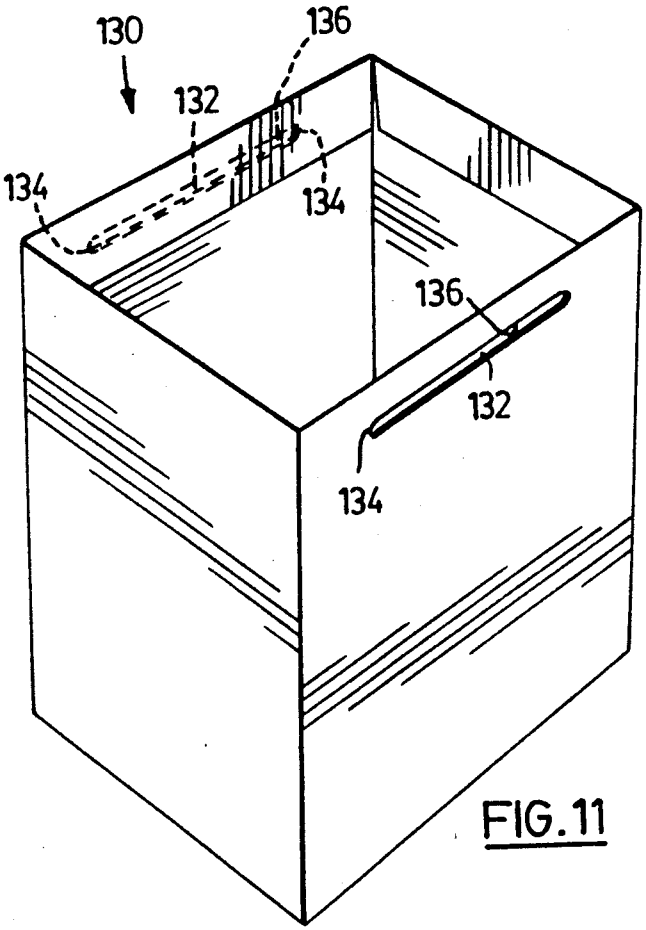
FIG. 11 is a perspective view of another embodiment of a carton constructed in accordance with the present invention.

Referring now to FIG. 11, a generally rectangular carton shown at 130 is similar in construction to the carton shown in FIG. 1 except that carton 130 includes a pair of slots 132 each located on an opposed side 14'. Slots 132 are provided with an elongate horizontal portion 132, end portions 136 and an upper slot edge 136. The unglued material between, and including slot edge 136 is bowed outwardly due to tension created in crease 22'. When slots are used in both the lid and the carton, the slots are spaced from the respective creases so that when the lid is received by the carton the slots come into registration in such a wa that the bowed out edges 110 in the lid passes over the bowed out edges 136 in the carton so that the bowed out portions interfere with one another thereby locking the lid on the carton.

Figure 12:
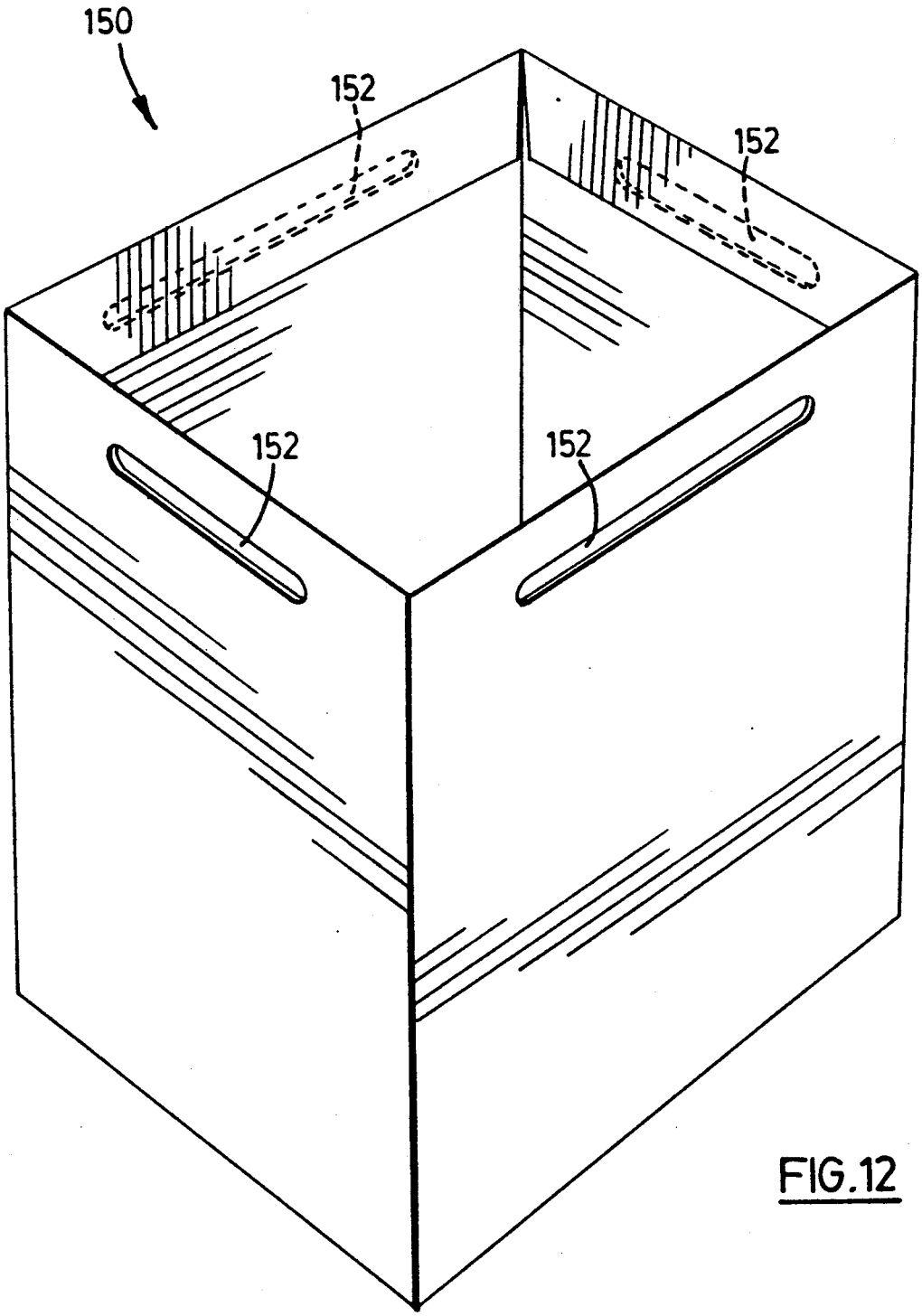
FIG. 12 is a perspective view of yet another embodiment of a carton embodying the subject invention.

FIG. 12 shows a carton 150 provided with slots 152 located on all four sides of the carton. A corresponding carton lid provided with either four slits similar to the two illustrated in FIG. 4 or four slots similar to the two shown in FIG. 8 may be used in conjunction with carton 150. This particular embodiment may be used for storing more difficult products (e.g. ice cream having 1% fat content which tend to be watery) if a more secure lock is required. It will be readily appreciated that cartons and lids using four slits on the four carton sides may also be employed.

While the interlocking carton and lid forming the present invention has been described and illustrated with respect to the preferred and alternative embodiments, it will be appreciated that numerous variations of these embodiments may be made without departing from the scope of the invention.

Therefore what is claimed is:

1. An interlocking carton and lid, comprising:

a) a generally rectangular storage carton having side members and a bottom member, the carton provided with a top opening for providing access into the interior of said carton, at least two opposed side members provided each with a peripheral flap integrally formed therewith at the upper edges thereof adjacent said top opening, the flaps adhesively coupled to the interior surface of the corresponding side members, the connection between the flaps and the side members forming a crease, said at least two opposed side members each provided with at least one slot located therein at a predetermined position between said crease and the outer edge of said flap, the adhesive coupling between said flap and the interior surface of the side member being positioned between said slot and the outer edge of said flap, wherein that unglued portion of the side member located between the crease and the slot is bowed outwardly due to spring tension created in said unglued portion by the close proximity of said slot to said crease, the slots being bounded by an upper edge and a lower edge, the upper edge of the slot also being the free edge of the unglued portion on the carton which is bowed outwardly; and b) a lid member having a generally rectangular, central portion, the peripheral edge portion of each side of said central portion provided with a flange member integrally formed therewith and extending substantially perpendicularly therefrom, the flange members including an outer member and an inner flap member, the connection between the inner flap portions and the outer members forming a crease, the flaps adhesively coupled to the interior surface of the corresponding outer members, said at least two opposed flange members each provided with at least one slit located on the flap member at a predetermined position between said crease and the outer peripheral edge of said flap, the adhesive coupling between said flap and the interior surface of the flange outer member being positioned between said slit and the outer edge of said flap, wherein that unglued portion of the flap member located between the crease and the slit is bowed outwardly due to spring tension created in said unglued portion by the close proximity of said slit to said crease, the slits in the lid and the slots in the carton being so located such that when the lid is placed on the carton the bowed out portion in the flap members pass over the bowed out portions in the carton side members so that the slots in the carton and the slits in the lid come into registration, and whereby the bowed out portion of the flap in the side members interferes with the bowed out portion of the flap on the lid flange members thereby locking the lid and carton together.

2. An interlocking carton and lid according to claim 1 wherein said carton and lid are fabricated from a cardboard material having a suitable fibrous component so that, when the cardboard is creased, tension is generated out of the plane of the cardboard in the local neighbourhood of the crease in the carton and lid.

3. An interlocking carton and lid according to claim 1 wherein the slits located on the lid flap members include a first slit portion extending substantially parallel to said crease on said flange, and including second split portions extending downwardly away from the crease and outwardly from the central portion of the respective slits.

4. An interlocking carton and lid according to claim 1 wherein said slits in said lid are slots, the slots being bounded by an upper edge and a lower edge, the lower edge of the slot also being the free edge of the unglued portion on the lid which is bowed outwardly, wherein when said lid is received on said carton the bowed out portion on said lid passes over said bowed out portion on said carton so that the bowed out portions interfere thereby locking the lid and carton together.

5. An interlocking carton and lid, comprising:

a) a generally rectangular storage carton having side members and a bottom member, the carton provided with a top opening for providing access into the interior of said carton, at least two opposed side members provided each with a peripheral flap integrally formed therewith at the upper edges thereof adjacent said top opening, the flaps adhesively coupled to the interior surface of the corresponding side members, the connection between the flaps and the side members forming a crease, said at least two opposed side members each provided with at least one slit located therein at a predetermined position between said crease and the outer edge of said flap, the adhesive coupling between said flap and the interior surface of the side member being positioned between said slit and the outer edge of said flap, wherein that unglued portion of the side member located between the crease and the slit is bowed outwardly due to spring tension created in said unglued portion by the close proximity of said slit to said crease; and b) a lid member having a generally rectangular, central portion, the peripheral edge portion of each side of said central portion provided with a flange member integrally formed therewith and extending substantially perpendicularly therefrom, the flange members including an outer member and an inner flap member, the connection between the inner flap portions and the outer members forming a crease, the flaps adhesively coupled to the interior surface of the corresponding outer members, said at least two opposed flange members each provided with at least one slot located on the flap member at a predetermined position between said crease and the outer peripheral edge of said flap, the slots being bounded by an upper edge and a lower edge, the upper edge of the slot also being the free edge of the unglued portion on the carton which is bowed outwardly the adhesive coupling between said flap and the interior surface of the flange outer member being positioned between said slot and the outer edge of said flap, wherein that unglued portion of the flap member located between the crease and the slot is bowed outwardly due to spring tension created in said unglued portion by the close proximity of said slot to said crease, the slot in the lid and carton being so located such that when the lid is placed on the carton the bowed out portion in the flap members pass over the bowed out portions in the carton side members so that the slits in the carton and the slots in the lid come into registration, and whereby the bowed out portion of the flap in the side members interferes with the bowed out portion of the flap on the lid flange members thereby locking the lid and carton together.

6. An interlocking carton and lid according to claim 5 wherein said carton and lid are fabricated from a cardboard material having a suitable fibrous component so that, when the cardboard is creased, tension is generated out of the plane of the cardboard in the local neighbourhood of the crease in the carton and lid.

7. An interlocking carton and lid according to claim 5 wherein said slits in said storage carton are slots, the slots being bounded by an upper edge and a lower edge, the upper edge of the slot also being the free edge of the unglued portion on the carton which is bowed outwardly, wherein when said lid is received on said carton the bowed out portion on said lid passes over said bowed out portion on said carton so that the bowed out portions interfere thereby locking the lid and carton together.

8. An interlocking carton and lid according to claim 5 wherein the slits located on the side members of the carton include a first slit portion extending substantially parallel to said crease on the carton, and including second slit portions extending from each end of said central slit portions downwardly away from the crease and outwardly from the central portion of the slit.

* * * * *